US009709315B2

(12) United States Patent
Son et al.

(10) Patent No.: US 9,709,315 B2
(45) Date of Patent: Jul. 18, 2017

(54) REFRIGERATOR AND RELAY MODULE OF COMPRESSOR FOR THE SAME

(71) Applicant: SAMSUNG ELECTRONICS CO., LTD., Suwon-si, Gyeonggi-do (KR)

(72) Inventors: Seok Jun Son, Gwangju (KR); Sung Cheol Kang, Gwangju (KR); Hyun Cheol Kim, Gwangju (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 815 days.

(21) Appl. No.: 13/650,621

(22) Filed: Oct. 12, 2012

(65) Prior Publication Data

US 2013/0091887 A1 Apr. 18, 2013

(30) Foreign Application Priority Data

Oct. 17, 2011 (KR) ..... 10-2011-0106047

(51) Int. Cl.
*F25B 1/00* (2006.01)
*F25B 49/00* (2006.01)
(Continued)

(52) U.S. Cl.
CPC ..... *F25D 23/00* (2013.01); *F25B 31/00* (2013.01)

(58) Field of Classification Search
USPC ..... 62/230
See application file for complete search history.

(56) References Cited

U.S. PATENT DOCUMENTS 3,898,860 A * 8/1975 Shepherd et al. ..... 62/155
5,170,307 A * 12/1992 Nacewicz ..... H01H 61/002 310/68 C (Continued)

FOREIGN PATENT DOCUMENTS

CN 2263773 Y 10/1997
CN 1229906 A 9/1999

(Continued)

OTHER PUBLICATIONS

Chinese Office Action mailed Nov. 4, 2015 in related Chinese Application No. 201210394859.6.

(Continued)

*Primary Examiner* — Marc Norman
*Assistant Examiner* — Daniel C Comings
(74) *Attorney, Agent, or Firm* — Staas & Halsey LLP

(57) ABSTRACT

A relay module includes a case forming an exterior of the relay module, a Positive Temperature Coefficient (PTC) device configured to control the supply of power to the compressor, a holder mounted at the case and configured to accommodate the PTC device, a start capacitor electrically connected to the PTC device, a first connecting terminal having a first PTC connecting terminal connected to the PTC device and a first capacitor connecting terminal connected to the start capacitor, and a second connecting terminal having a second PTC connecting terminal connected to the PTC device and a second capacitor connecting terminal connected to the start capacitor. The first capacitor connecting terminal and the second capacitor connecting terminal are spaced apart a predetermined distance from a bottom surface of the case.

7 Claims, 7 Drawing Sheets

(51) Int. Cl.
*F25D 23/00* (2006.01)
*F25B 31/00* (2006.01)

(56) References Cited

U.S. PATENT DOCUMENTS

| | | | | |
|---|---|---|---|---|
| 9,025,286 | B2 * | 5/2015 | Washburn | H01H 61/002 29/825 |
| 2003/0012669 | A1 * | 1/2003 | Kawashima | F04B 39/12 417/423.1 |
| 2006/0101841 | A1 * | 5/2006 | Park | 62/298 |

FOREIGN PATENT DOCUMENTS

| | | | |
|---|---|---|---|
| CN | 1776970 | A | 5/2006 |
| CN | 201129904 | Y | 10/2008 |
| JP | 2006-147529 | | 6/2006 |
| KR | 2019980004088 | | 3/1998 |
| KR | 10-2007-0011930 | | 1/2007 |

OTHER PUBLICATIONS

Chinese Office Action dated Nov. 30, 2016 from Chinese Patent Application No. 201210394859.6, 4 pages.

* cited by examiner

REFRIGERATOR AND RELAY MODULE OF COMPRESSOR FOR THE SAME

CROSS-REFERENCE TO RELATED APPLICATIONS

This application claims the benefit of Korean Patent Application No. 2011-0106047, filed on Oct. 17, 2011 in the Korean Intellectual Property Office, the disclosure of which is incorporated herein by reference.

BACKGROUND

1. Field

Embodiments of the present disclosure relate to a relay module of a compressor used as a starting and protective apparatus and installed to a refrigerator.

2. Description of the Related Art

In general, a refrigerator is an apparatus configured to store foods fresh by having storage compartment to store foods and a cool air supplying apparatus to supply cool air to the storage compartment.

The cold air supplying apparatus includes a compressor configured to compress refrigerant to high-temperature, high-pressure vapor, a condenser configured to condense the refrigerant gas that is compressed to a medium-temperature, high-pressure liquid, an expansion valve configured to expand the compressed refrigerant to low-temperature, low-pressure liquid, and an evaporator configured to evaporate the expanded refrigerant to low-temperature, low-pressure vapor, thereby supplying the storage compartment with a cool air through a cooling cycle including the compression, the condensation, the expansion and the evaporation.

The compressor, one of the elements forming the cool air supplying apparatus as such, is connected to a start relay configured to control the supply of power and to an overload protector configured to protect the compressor from being damaged by shutting off the power in a case of an overload of the compressor. The start relay and the overload protector as such may be provided as a single unit while being accommodated in a single case.

Meanwhile, a tracking, which is a leakage of electric current between two points separated by an insulating material caused by foreign substances such as dirt, carbon particles and moisture, may develop between the terminals of the start relay due to the foreign substances permeated into an inside of the case through a gap thereof, and a fire may occur as a result.

SUMMARY

Therefore, it is an aspect of the present disclosure to provide a relay module of a compressor configured to prevent the formation of a tracking by foreign substances introduced to an inside a case.

Additional aspects of the disclosure will be set forth in part in the description which follows and, in part, will be apparent from the description, or may be learned by practice of the disclosure.

In accordance with one aspect of the present disclosure, a refrigerator includes a body, a storage compartment and a cool air supplying apparatus. The storage compartment may be provided at an inside the body to store food. The cool air supplying apparatus may have a compressor, a condenser, an expansion valve, an evaporator, a draft fan, and a cool air duct. A relay module, which is configured to control the supply of power and to prevent damage due to an overload, is coupled to the compressor. The relay module may include a case, a Positive Temperature Coefficient (PTC) device, an overload protector, a start capacitor, a first connecting terminal and a second connecting terminal and a separating chamber. The case may form an exterior of the relay module. The PTC device may be configured to control the supply of power to the compressor. The overload protector may be configured to shut off the supply of power in a case when an overload occurs at the compressor. The start capacitor may be electrically connected to the PTC device. The first connecting terminal and the second connecting terminal may be configured to electrically connect the PTC device to the start capacitor. The separating chamber may be formed among the first connecting terminal, the second connecting terminal and a bottom surface of the case to prevent a tracking from occurring between the first connecting terminal and the second connecting terminal due to foreign substance.

The separating chamber may be configured in a way that the first connecting terminal and the second connecting terminal are spaced apart in a predetermined distance from the bottom surface of the case.

The first connecting terminal may be disposed at a left side of the PTC device, and the second connecting terminal may be disposed at a right side of the PTC device.

The first connecting terminal and the second connecting terminal may be disposed at a height corresponding to each other.

The relay module may further include a holder that is disposed at the case so as to accommodate the PTC device, and the separating chamber may be formed between the holder and the bottom surface of the case.

The holder may be spaced apart in a predetermined distance from the bottom surface of the case. The case may have a holder accommodating unit where the holder is fitted to the holder accommodating unit so as to be spaced apart from the bottom surface of the case.

In accordance with another aspect of the present disclosure, a refrigerator includes a body, a storage compartment and a cool air supplying apparatus. The storage compartment may be provided at an inside the body to store food. The cool air supplying apparatus may have a compressor, a condenser, an expansion valve, an evaporator, a draft fan, and a cool air duct. A relay module, which is configured to control the supply of power and prevent damage due to an overload, is coupled to the compressor. The relay module may include a case, a Positive Temperature Coefficient (PTC) device, an overload protector, a start capacitor, a first connecting terminal, and a second connecting terminal. The case may form an exterior of the relay module. The PTC device may be configured to control the supply of power to the compressor. The overload protector may be configured to shut off the supply of power in a case when an overload occurs at the compressor. The start capacitor may be electrically connected to the PTC device. The first connecting terminal may have a first PTC connecting terminal connected to the PTC device and a first capacitor connecting terminal connected to the start capacitor. The second connecting terminal may have a second PTC connecting terminal connected to the PTC device and a second capacitor connecting terminal connected to the start capacitor. The first capacitor connecting terminal and the second capacitor connecting terminal may be spaced apart in a predetermined distance from a bottom surface of the case.

The first connecting terminal and the second connecting terminal may be disposed at a height corresponding to each other.

The relay module may have a holder mounted at the case and configured to accommodate the PTC device. The holder may be spaced apart in a predetermined distance from the bottom surface of the case. The case may have a holder accommodating unit and the holder may be fit to the holder accommodating unit so as to be spaced apart from the bottom surface of the case.

A bottom surface of the holder, the first capacitor connecting terminal, and the second connecting terminal may be disposed at a corresponding height to one another.

The first connecting terminal may be provided with a first compressor connecting terminal connected to an input terminal of the compressor, and the second connecting terminal may be provided with a second compressor connecting terminal connected to an input terminal of the compressor.

The case may include a base and a cover coupled to an open front surface of the base, and the cover may be provided thereon with a first penetrating hole that allows the first capacitor connecting terminal to penetrate therethrough and a second penetrating hole that allows the second capacitor connecting terminal to penetrate therethrough.

In accordance with another aspect of the present disclosure, a relay module, mounted to a compressor of a refrigerator and configured to control the supply of power to the compressor and to prevent a damage by an overload, includes a case, a PTC device, a holder, an overload protector, a start capacitor, a first connecting terminal and a second connecting terminal. The case may form an exterior of the relay module. The PTC device may be configured to control the supply of power to the compressor. The holder may be mounted at the case and configured to accommodate the PTC device. The overload protector may be configured to shut off the supply of power in a case an overload occurs at the compressor. The start capacitor may be electrically connected to the PTC device. A first connecting terminal and a second connecting terminal may be configured to electrically connect the PTC device to the start capacitor. The first connecting terminal and the second connecting terminal may be spaced apart a predetermined distance from a bottom surface of the case. The first connecting terminal may have a first PTC connecting terminal connected to the PTC device and a first capacitor connecting terminal connected to the start capacitor. The second connecting terminal may have a second PTC connecting terminal connected to the PTC device and a second capacitor connecting terminal connected to the start capacitor.

The holder may be spaced apart in a predetermined distance from the bottom surface of the case.

In accordance with an aspect of the present disclosure, a tracking does not occur since foreign substances are not in contact with a terminal, even in a case when a foreign substance such as moisture is introduced into and collected at an inside of a case of a relay module.

Thus, a fire that may be developed due to a short circuit generated by a tracking between terminals may be prevented.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
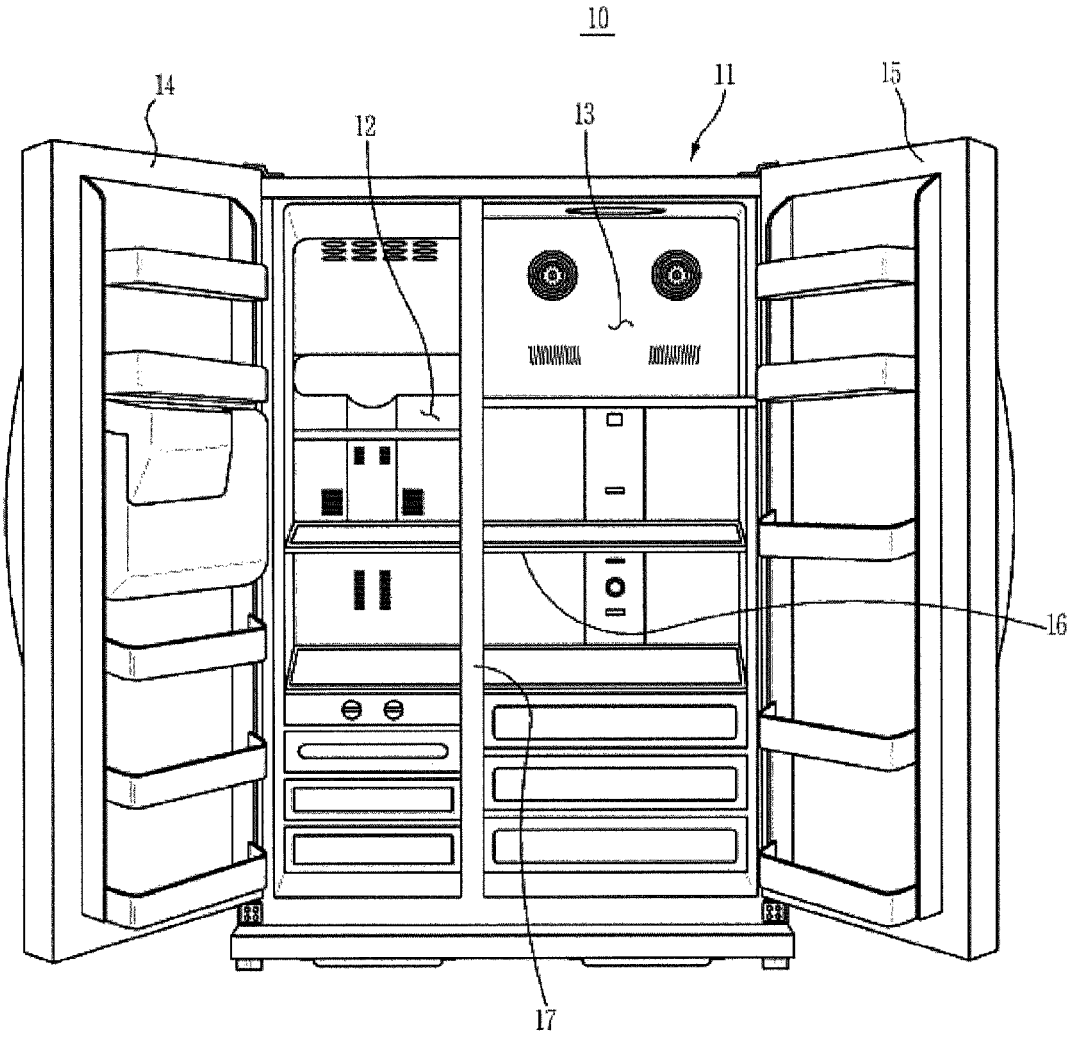
FIG. 1 is a drawing illustrating an exterior of a refrigerator in accordance with an embodiment of the present disclosure.

Reference will now be made in detail to the embodiments of the present disclosure, examples of which are illustrated in the accompanying drawings, wherein like reference numerals refer to like elements throughout.

Figure 2:
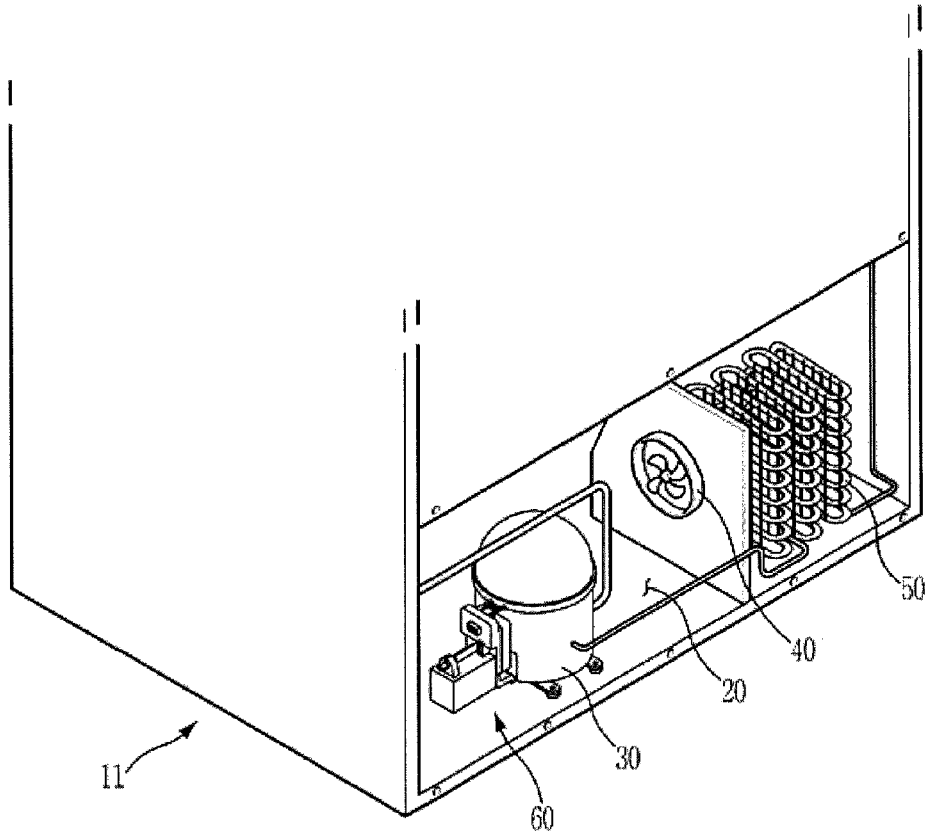
FIG. 2 is a drawing illustrating a machinery compartment and a compressor of the refrigerator of FIG. 1.

FIG. 1 is a drawing illustrating an exterior of a refrigerator in accordance with an embodiment of the present disclosure, and FIG. 2 is a drawing illustrating a machinery compartment and a compressor of the refrigerator of FIG. 1.

A refrigerator 10 according to an embodiment of the present disclosure includes a body 11, storage compartments 12 and 13 provided to store foods at an inside the body 11, and a cool air supplying apparatus configured to supply cool air to the storage compartments 12 and 13.

The body 11 includes an outer case forming the exterior of the refrigerator 10, an inner case forming the storage compartments 11 and 12, and an insulation material to insulate the storage compartments 11 and 12 while being foamed between the inner case and the outer case.

The storage compartments 12 and 13 are provided in a state of having an open front surface thereof to withdraw/place food therethrough, and a shelf 16 may be disposed at the storage compartments 12 and 13 to place food therein and vertically divide the storage compartments 12 and 13.

The storage compartments 12 and 13 may be divided into a first storage compartment 12 on a left and a second storage compartment 13 on a right by a vertical partition 17, and the first storage compartment 12 and the second storage compartment 13 may be used as a refrigerating compartment and a freezing compartment, respectively.

The first storage compartment 12 is provided with a first door 14 rotatively coupled thereto to open/close the open front surface thereof, and the second storage compartment 13 is provided with a second door 15 rotatively coupled thereto to open/close the open front surface thereof.

Although the structure of the refrigerator illustrated on FIG. 1 according to the first embodiment of the present disclosure is a type of a refrigerator provided with a refrigerating compartment on a left and a freezing compartment a right while having the vertical patrician 17 formed therein-between as a center, it is certain that the aspect of the present disclosure is not limited to the refrigerator as such, but may also be applied to other types of refrigerators such as a single door refrigerator, a Bottom Mounted Freezer (BMF)-style refrigerator, a TMF (Top Mounted Freezer)-type refrigerator, and a French Door Refrigerator (FDR)-type refrigerator.

The cool air supplying apparatus configured to supply cool air to the storage compartments 12 and 13 as such includes components such as a compressor 30 (see FIG. 2), a condenser 50 (see FIG. 2), an expansion valve (not shown), and an evaporator (not shown).

As illustrated on FIG. 2, the compressor 30 and the condenser 50 among the components of the cool air supplying apparatus may be mounted to a machinery compartment 20 provided at a bottom rear side of the body 11. A refrigerant pipe at which refrigerant flows through is connected between the compressor 30 and the condenser 50, and a draft fan 40 may be mounted at the surrounding of the condenser 50 to facilitate heat exchange.

Meanwhile, the compressor 30 compresses refrigerant gas at low temperature and low pressure to refrigerant gas at high temperature and high pressure, as a rotator is rotated at high speed with respect to a stator. The compressor 30 as such is provided in a form of a cylindrical shape, and an integrated relay module 60 is coupled to one side of a circumferential surface of the compressor 30.

The integrated relay module 60 represents a single unit formed by having a start relay configured to control the supply of power to the compressor 30, an overload protector configured to protect the compressor 30 by shutting off the supply of power to the compressor 30, and a start capacitor electrically connected to the start relay. Meanwhile, although this embodiment shows an integrated relay module 60 having an integrated start relay, overload protector, and start capacitor, the present disclosure can be applied to a relay structure in which these elements are provided separately.

The integrated relay module 60 as such may be coupled to the compressor 30 as at least one locking protrusion 81 is insertedly coupled to a locking hole 96 formed at an outer circumferential surface of the compressor 30. The structure of the integrated relay module 60 as such will be explained hereafter.

Figure 3:
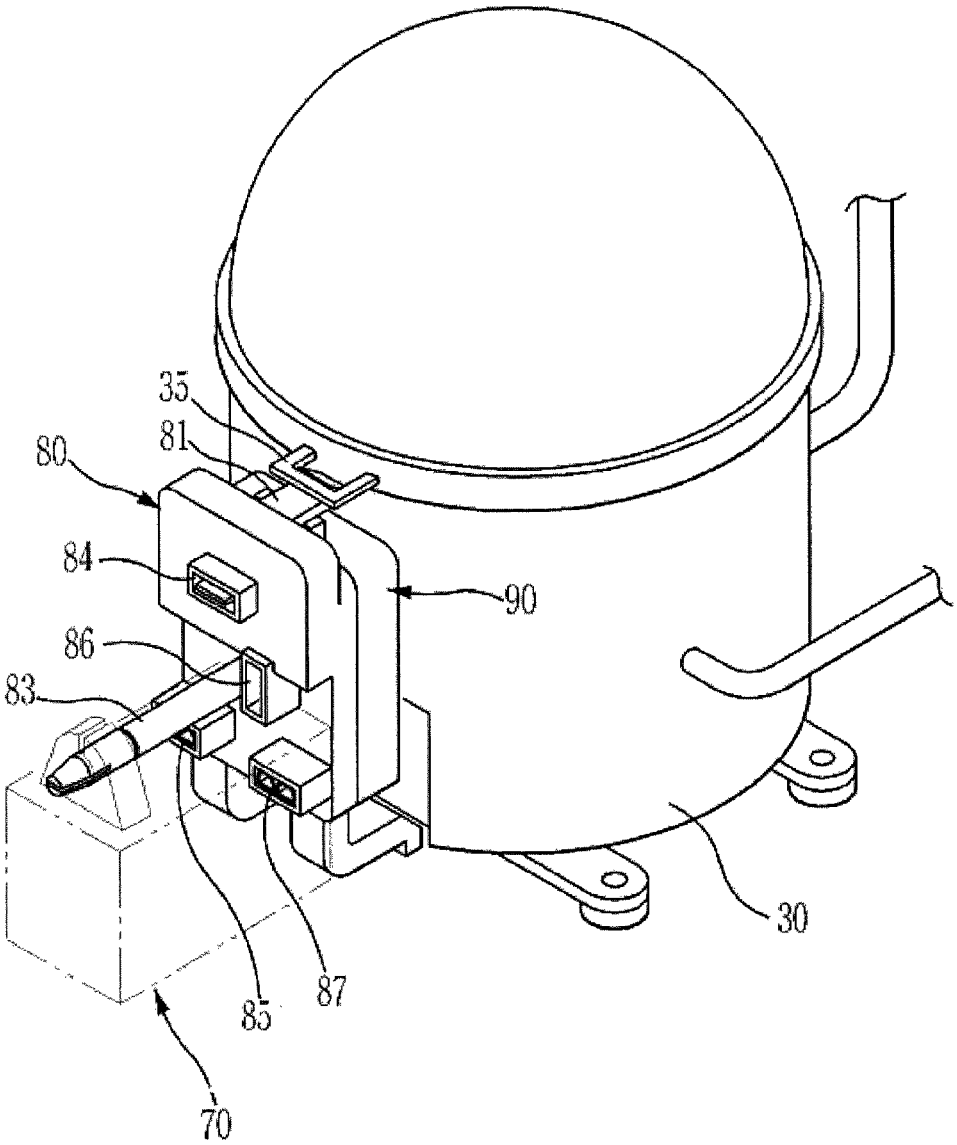
FIG. 3 is a drawing illustrating a compressor and an integrated relay module of the refrigerator of FIG. 1.
Figure 4:
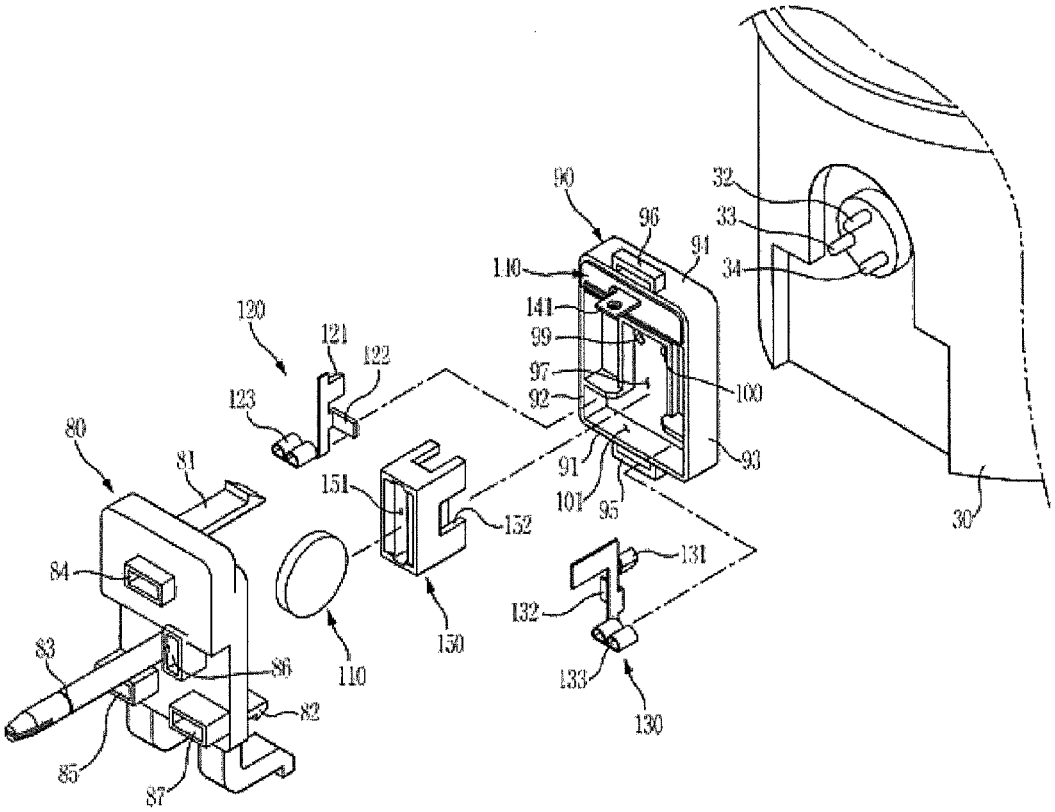
FIG. 4 is an exploded perspective view of an integrated relay module of the refrigerator of FIG. 1.
Figure 5:
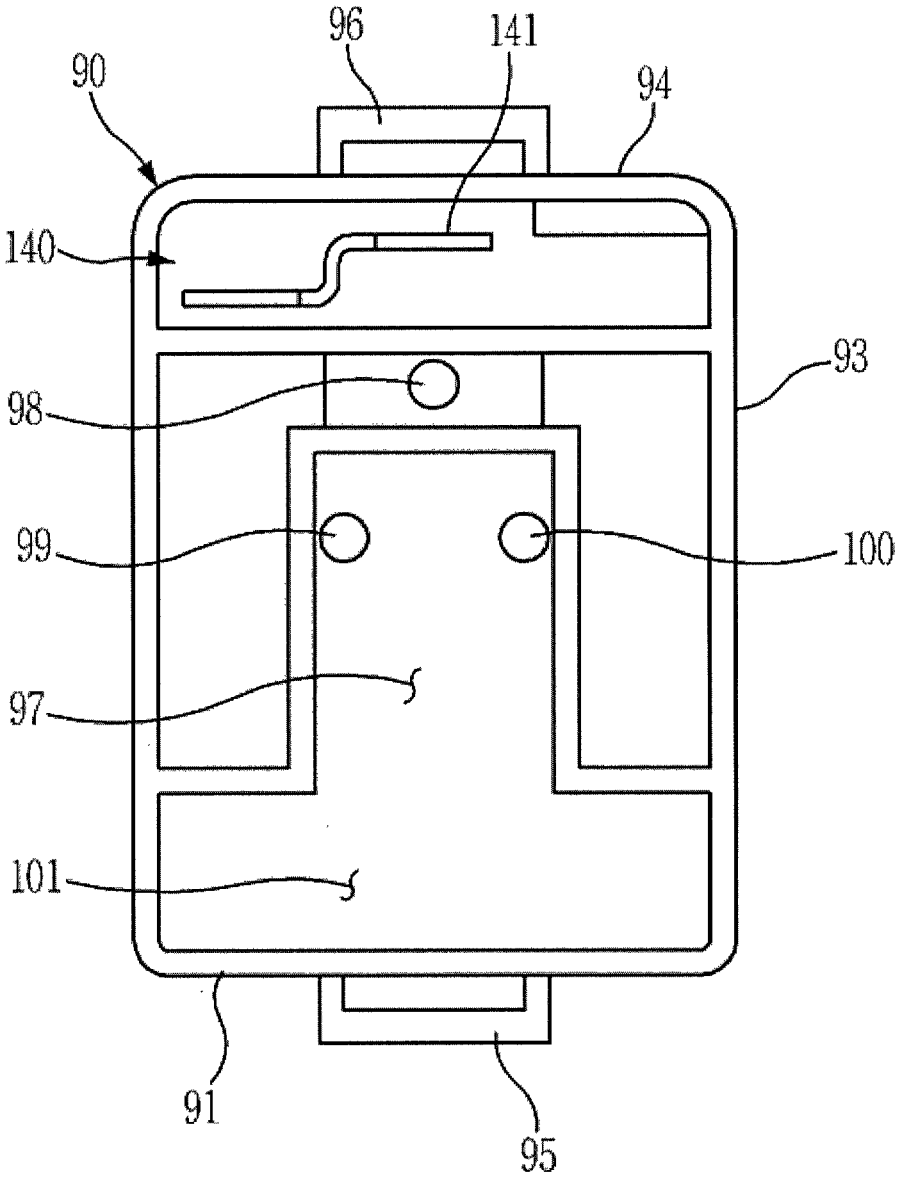
FIG. 5 is a front side view of an integrated relay module of the refrigerator of FIG. 1.
Figure 6:
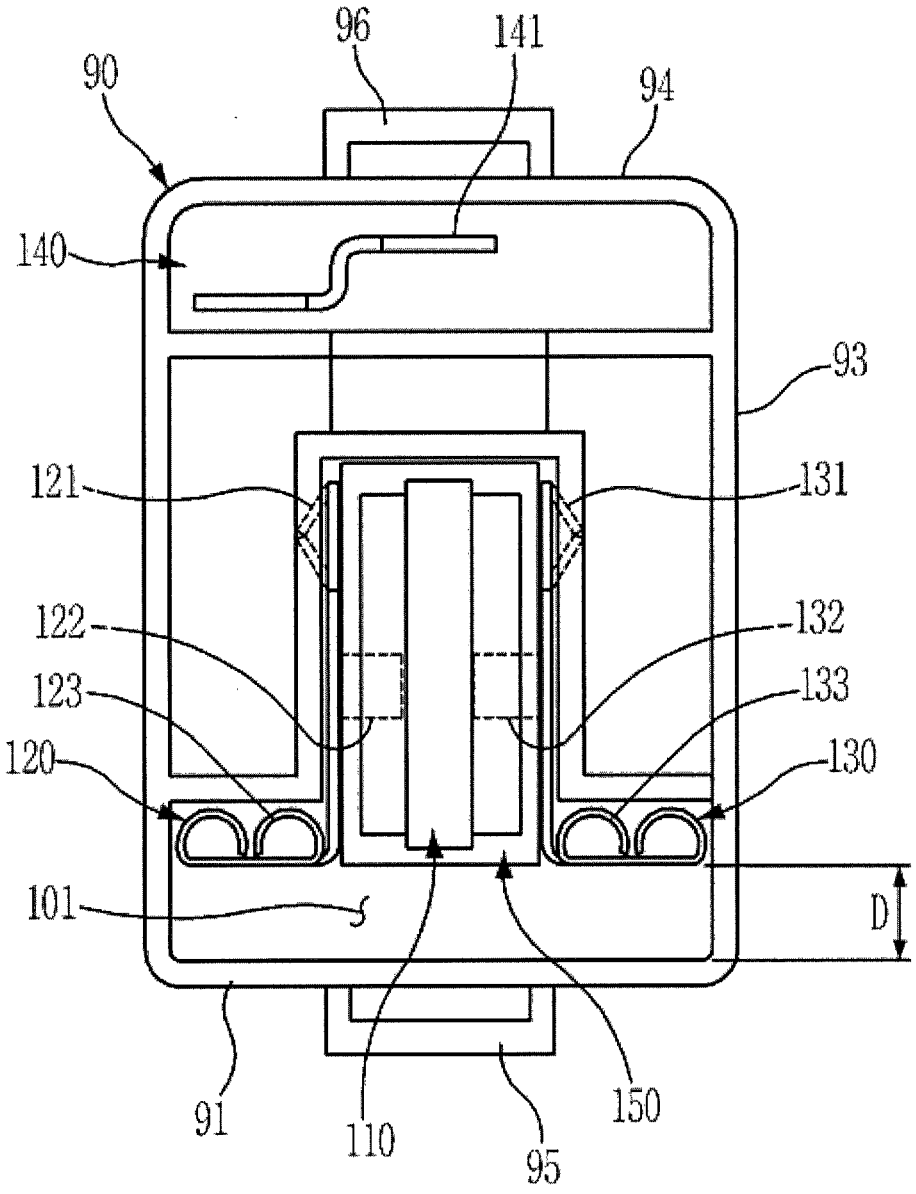
FIG. 6 is a front side view of a base of an integrated relay module of the refrigerator of FIG. 1, in which a PTC device and a connecting terminal are mounted thereto.
Figure 7:
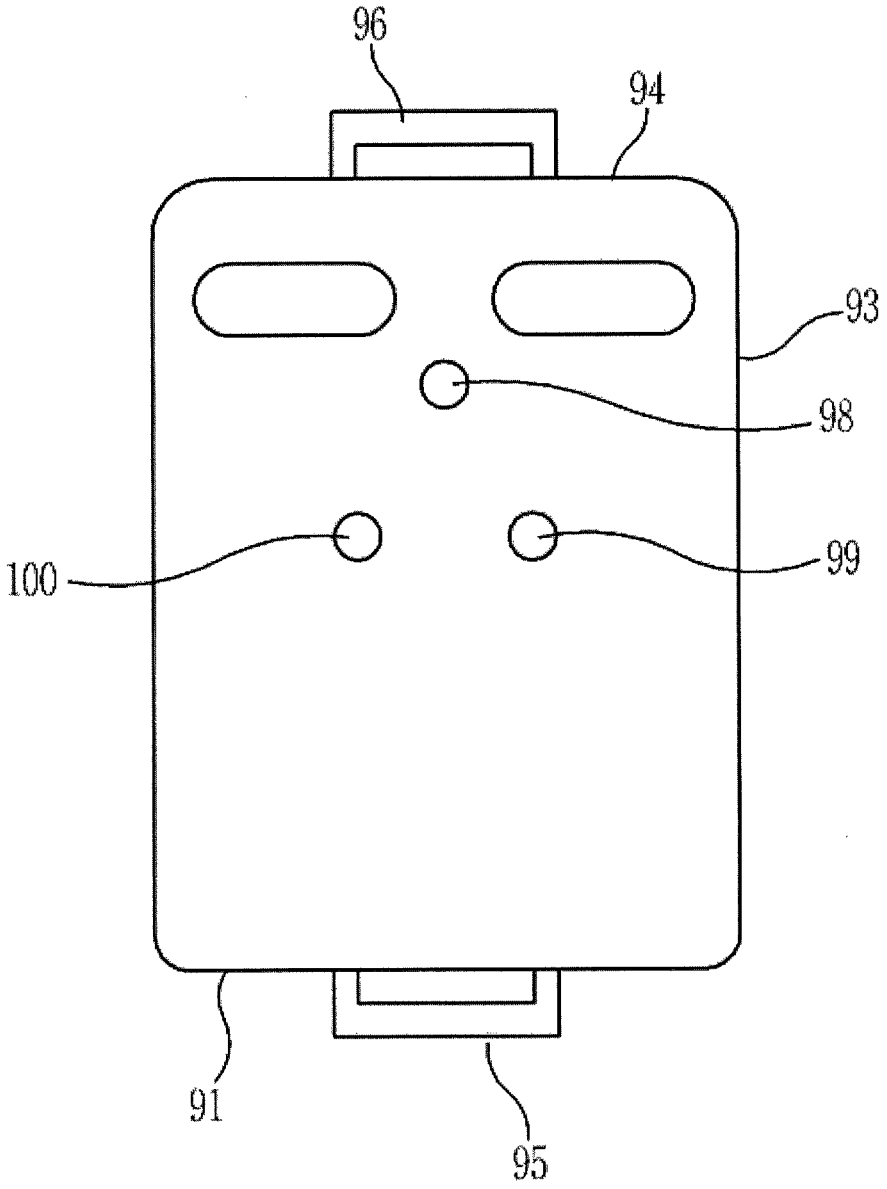
FIG. 7 is a rear side view of a base of an integrated relay module of the refrigerator of FIG. 1.

FIG. 3 is a drawing illustrating a compressor and an integrated relay module of the refrigerator of FIG. 1, FIG. 4 is an exploded perspective view of an integrated relay module of the refrigerator of FIG. 1, FIG. 5 is a front side view of an integrated relay module of the refrigerator of FIG. 1, FIG. 6 is a front side view of a base of an integrated relay module of the refrigerator of FIG. 1, in which a PTC device and a connecting terminal are mounted thereto, and FIG. 7 is a rear side view of a base of an integrated relay module of the refrigerator of FIG. 1.

Referring to FIGS. 2 to 4, the integrated relay module 60 may include cases 80 and 90 forming the exterior of the integrated relay module 60, a start relay accommodated at an inside the cases 80 and 90, an overload protector 140 accommodated at an inside the cases 80 and 90, and a capacitor 70 (see FIG. 3) coupled to a front of the cases 80 and 90.

As illustrated, the cases 80 and 90 may include a base 90 configured to mount various components and coming into close contact with the compressor 30, and a cover 80 coupled to a front surface of the base 90 to close the open front surface of the base 90. The base 90 and the cover 80 may be formed by injection molding.

The base 90 may be provided in a form of a rectangular shape having an open front surface and a space formed at an inside therein. The base 90 may include a bottom surface 91, a left side surface 92, a right side surface 93, and an upper side surface 94.

The base 90 is provided with penetrating holes 98, 99, and 100 formed thereon so that input terminals 32, 33, and 34 of the compressor 30 may penetrate into the inside the base 90. In addition, a locking hole 95 may be formed at a lower end of the base 90 so that a locking protrusion 82 of the cover 80 is insertedly coupled to the base 90.

The start relay may include a PTC (Positive Temperature Coefficient) device 110, a holder 150 mounted on the base 90 to accommodate the PTC device 110, a first connecting terminal 120 disposed on a left side of the holder 150, and a second connecting terminal 130 disposed on a right side of the holder 150.

The PTC device 110 may be able to control the supply of power to the compressor 30 as resistance is variable according to temperature change. The PTC device 110 may be fixedly mounted to the base 90 through the holder 150.

The holder 150 may be mounted to a holder accommodating unit 97 formed at a central portion of the base 90. The holder 150 may include a PTC device insertion hole 151 configured to accommodate the PTC device 110 and a pair of opening parts 152 formed at both sides of the PTC device insertion hole 151.

The PTC device 110 may be connected to the first connecting terminal 120 and the second connecting terminal 130, disposed at either side of the holder 150, through the pair of opening parts 152 formed at both sides of the holder 150.

The first connecting terminal 120 electrically connects the PTC device 110, the capacitor 70, and the input terminal 33 of the compressor 30. For such, the first connecting terminal 120 may include a first capacitor connecting terminal 123 connected to the capacitor 70, a first PTC connecting terminal 122 connected to the PTC device 110, and a first compressor connecting terminal 121 connected to the compressor input terminal 33.

The first capacitor connecting terminal 123 may be formed in a protruded manner from a lower portion to a front surface of the first connecting terminal 120, the first compressor connecting terminal 121 may be formed in a protruded manner from an upper portion toward a rear of the first connecting terminal 120, and the first PTC connecting terminal 122 may be formed in a protruded manner from in between the first capacitor connecting terminal 123 and the first compressor connecting terminal 121 toward a right side thereof.

The first capacitor connecting terminal 123 may be connected to the capacitor 70, which is coupled to a front of the cover 80, through the first penetrating hole 85 of the cover 80. The first compressor connecting terminal 121 may be connected to the compressor 30 through the first compressor terminal penetrating hole 99 of the base 90. The first PTC connecting terminal 122 may be connected to the PTC device 110 through an opening part (now shown) of the holder 150.

In a similar manner, the second connecting terminal 130 electrically connects the PTC device 110, the capacitor 70, and the input terminal 34 of the compressor 30. For such, the second connecting terminal 130 may include a second capacitor connecting terminal 133 connected to the capacitor 70, a second PTC connecting terminal 132 connected to the PTC device 110, and a second compressor connecting terminal 131 connected to the compressor input terminal 34.

The second capacitor connecting terminal 133 is formed in a protruded manner from a lower portion to a front of the second connecting terminal 130, the second compressor connecting terminal 131 is formed in a protruded manner from an upper portion to a rear of the second connecting terminal 130, and the second PTC connecting terminal 132 is formed in a protruded manner from in between the second capacitor connecting terminal 133 and the second compressor connecting terminal 131 toward a left side thereof.

The second capacitor connecting terminal 133 may be connected to the capacitor 70, which is coupled to a front of the cover 80, through the second penetrating hole 87 of the cover 80, the second compressor connecting terminal 131 may be connected to the compressor 30 through the second compressor terminal penetrating hole 100 of the base 90, and the second PTC connecting terminal 132 may be connected to the PTC device 110 through the opening part 152 of the holder 150.

Meanwhile, the overload protector 140, in a case when an overload occurs at the compressor 30, is configured to shut off the supply of power to the compressor 30, and may be installed at an upper portion of the base 90. The cover 80 is provided thereon with a penetrating hole 84 configured in a way that a terminal 141 of the overload protector 140 may pass through to connect an outside power to the overload protector 140.

The cover 80, as explained previously, is coupled to an open front surface of the base 90 provided with the holder 150, the PTC device 110, the first connecting terminal 120, the second connecting terminal 130, and the overload protector 140 mounted thereto, and is configured to seal the above components, as well as to form the cases in cooperation with the base 90.

However, foreign substances such as moisture may permeate to an inside the case through the penetrating holes 84, 85, 86, and 87, which are formed on the cover 80 to connect the components at an inside of the case to an outside power, or to the capacitor at an outside. In addition, foreign substances such as moisture may permeate to an inside of the case through a gap between the coupling surfaces of the cover 80 and the base 90.

In such a case, the foreign substance such as moisture is collected on a bottom surface 91 of the case. In this case when the foreign substance collected as such is in contact with the first connecting terminal 120 and the second connecting terminal 130, a tracking, that is, a carbonized conduction path, is formed between the first connecting terminal 120 and the second connecting terminal 130, and a fire may develop due to a short circuit between the first connecting terminal 120 and the second connecting terminal 130.

Thus, as illustrated on FIG. 6, the integrated relay module of the refrigerator according to the embodiment of the present disclosure includes a separating chamber 101 configured to separate the bottom surface 91 of the case from the first connecting terminal 120 and the second connecting terminal 130 to prevent the formation of the tracking as such.

The separating chamber 101 is formed right at an upper side of the bottom surface 91 of the case so as to space apart the first connecting terminal 120 and the second connecting terminal 130 from the bottom surface 91 of the case in a predetermined distance D. In particular, the first connecting terminal 120 and the second connecting terminal 130 include the first and the second capacitor connecting terminals 123 and 133, respectively, and the first and the second capacitor connecting terminal 123 and 133 are spaced from the bottom surface 91 of the case, as shown in FIG. 6.

The separating chamber 101, while accommodating foreign substances, such as moisture, introduced into the case and then accumulated on the button surface 91 while preventing the foreign substances from making contact with the first connection terminal 120 or the second connecting terminal 130.

Thus, the tracking is not formed between the first connecting terminal 120 and the second connecting terminal 130. Therefore, a difficulty due to a short circuit may not occur.

The first connecting terminal 120 and the second connecting terminal 130 as such may be disposed at a corresponding height to each other. In addition, at this time, the holder 150 mounted between the first connecting terminal 120 and the second connecting terminal 130 also may be spaced apart from the bottom surface 130 of the case, and may be disposed at a corresponding height to the first connecting terminal 120 and the second connecting terminal 130. The holder 150 can be tightly fitted to the holder accommodating unit 97 to maintain the holder 150 and the first and the second connecting terminals 120 and 130 spaced from the bottom surface 91 of the case. Other structures to space the holder 150 and the first and the second connecting terminals 120 and 130 from the bottom surface 91 of the case can also be adopted.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator, comprising:

a body;

a storage compartment provided inside the body;

a cool air supplying apparatus having a compressor;

a start capacitor; and a relay module is configured to control a supply of power connected to the compressor, wherein the relay module comprises a case forming an exterior of the relay module, the start capacitor connected to a front of the case;

a Positive Temperature Coefficient (PTC) device configured to control the supply of power to the compressor;

a first connecting terminal configured to electrically connect the PTC device to the start capacitor including a first PTC connecting terminal connected to the PTC device and a first capacitor connecting terminal penetrating the case and connected to the start capacitor;

a second connecting terminal configured to electrically connect the PTC device to the start capacitor including a second PTC connecting terminal connected to the PTC device and a second capacitor connecting terminal penetrating the case and connected to the start capacitor; and a holder to accommodate the first connecting terminal and the second connecting terminal, the first and second connecting terminals and the holder disposed in the case to be encompassed by the case and to form a separating chamber between a bottom surface of the case and the first and second connecting terminals and the holder, the separating chamber causing the first and second connecting terminals and the holder to be spaced apart a distance from the bottom surface of the case to prevent a tracking between the first and second connecting terminals due to foreign substances at the bottom surface of the case.

2. The refrigerator of claim 1, wherein the first connecting terminal is disposed at a left side of the PTC device, and the second connecting terminal is disposed at a right side of the PTC device.

3. The refrigerator of claim 1, wherein the first connecting terminal and the second connecting terminal are disposed at a vertical position corresponding to each other.

4. The refrigerator of claim 1, wherein the holder is spaced apart the distance from the bottom surface of the case.

5. The refrigerator of claim 1, wherein the case includes a holder accommodating unit, the holder being held by the holder accommodating unit so as to be spaced apart from the bottom surface of the case.

6. The refrigerator of claim 1, wherein the case comprises a base and a cover coupled to an open front surface of the base, and the cover is provided thereon with a first penetrating hole that allows the first capacitor connecting terminal to penetrate therethrough and a second penetrating hole that allows the second capacitor connecting terminal to penetrate therethrough.

7. The refrigerator of claim 1, wherein the relay module further comprises an overload protector configured to shut off the supply of power when an overload occurs at the compressor, the overload protector being formed in the case above the first connecting terminal and the second connecting terminal.

* * * * *